US008985207B2

(12) United States Patent
Thorkildsen et al.

(10) Patent No.: US 8,985,207 B2
(45) Date of Patent: Mar. 24, 2015

(54) METHOD AND APPARATUS FOR USE WITH AN INFLOW CONTROL DEVICE

(75) Inventors: Tage Thorkildsen, Raege (NO); Timo Jokela, Randaberg (NO); Pavel Petukhov, Stavanger (NO); Marius Destad, Oslo (NO); Edvin Eimstad Riisem, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 535 days.

(21) Appl. No.: 13/154,477

(22) Filed: Jun. 7, 2011

(65) Prior Publication Data

US 2011/0303420 A1 Dec. 15, 2011

Related U.S. Application Data

(60) Provisional application No. 61/354,597, filed on Jun. 14, 2010.

(51) Int. Cl.
*E21B 43/04* (2006.01)
*E21B 34/06* (2006.01)

(52) U.S. Cl.
CPC ..... *E21B 34/063* (2013.01)
USPC ..... 166/278; 166/51; 166/373; 166/386; 166/320; 137/71; 137/67

(58) Field of Classification Search
None
See application file for complete search history.

(56) References Cited

U.S. PATENT DOCUMENTS

| | | | |
|---|---|---|---|
| 2,132,081 | A | 10/1938 | Nixon |
| 2,340,481 | A | 2/1944 | Lloyd |
| 4,688,593 | A | 8/1987 | Pringle |
| 5,127,474 | A | 7/1992 | Schroeder, Jr. et al. |
| 5,168,931 | A | 12/1992 | Caskey |
| 6,220,350 | B1 | 4/2001 | Brothers et al. |
| 6,719,051 | B2 | 4/2004 | Hailey, Jr. et al. |
| 6,899,176 | B2 | 5/2005 | Hailey, Jr. et al. |
| 6,938,698 | B2 | 9/2005 | Coronado |
| 7,096,945 | B2 | 8/2006 | Richards et al. |
| 7,240,739 | B2 | 7/2007 | Schoonderbeek |
| 7,350,582 | B2 | 4/2008 | McKeachnie et al. |
| 7,775,283 | B2 | 8/2010 | Coronado et al. |
| 7,775,284 | B2 | 8/2010 | Richards et al. |
| 7,798,236 | B2 | 9/2010 | McKeachnie et al. |
| 7,870,906 | B2 | 1/2011 | Ali |
| 7,891,432 | B2 | 2/2011 | Assal |

(Continued)

FOREIGN PATENT DOCUMENTS

WO 2011004161 A2 1/2011

OTHER PUBLICATIONS

Hans-Emil Bensnes Torbergsen, Application and Design of Passive Inflow Control Devices on the Eni Goliat Oil Producer Wells, Master's Thesis—University of Stavanger, Autumn Semester 2010.

(Continued)

*Primary Examiner* — Jennifer H Gay
*Assistant Examiner* — Caroline Butcher

(57) ABSTRACT

A completion assembly is run downhole into a well. The assembly includes a valve and a material that is adapted to initially configure the valve to prevent fluid flow through the valve in at least one direction. The technique includes performing a downhole completion operation in the well and disintegrating the material to allow the prevented fluid flow through a nozzle of the valve. The nozzle is used to regulate production or injection in the well.

27 Claims, 6 Drawing Sheets

(56) References Cited

U.S. PATENT DOCUMENTS

| | | | | |
|---|---|---|---|---|
| 8,037,940 | B2 | 10/2011 | Patel et al. | |
| 2003/0141060 | A1 | 7/2003 | Hailey, Jr. et al. | |
| 2003/0141061 | A1 | 7/2003 | Hailey, Jr. et al. | |
| 2004/0020832 | A1 | 2/2004 | Richards et al. | |
| 2004/0256114 | A1 | 12/2004 | Coronado | |
| 2006/0027377 | A1 | 2/2006 | Schoonderbeek et al. | |
| 2006/0131031 | A1 | 6/2006 | McKeachnie et al. | |
| 2007/0074873 | A1* | 4/2007 | McKeachnie et al. | 166/376 |
| 2008/0060803 | A1 | 3/2008 | Badalamenti | |
| 2008/0135249 | A1* | 6/2008 | Fripp et al. | 166/285 |
| 2008/0135255 | A1 | 6/2008 | Coronado | |
| 2008/0149345 | A1 | 6/2008 | Marya | |
| 2009/0065199 | A1 | 3/2009 | Patel et al. | |
| 2009/0078428 | A1 | 3/2009 | Ali | |
| 2009/0084556 | A1* | 4/2009 | Richards et al. | 166/329 |
| 2009/0101342 | A1* | 4/2009 | Gaudette et al. | 166/276 |
| 2009/0101354 | A1* | 4/2009 | Holmes et al. | 166/373 |
| 2009/0120647 | A1 | 5/2009 | Turick et al. | |
| 2009/0159279 | A1* | 6/2009 | Assal | 166/278 |
| 2009/0211769 | A1 | 8/2009 | Assal | |
| 2009/0283275 | A1 | 11/2009 | Hammer | |
| 2010/0051262 | A1 | 3/2010 | Dusterhoft et al. | |
| 2010/0051270 | A1* | 3/2010 | Dusterhoft et al. | 166/278 |
| 2011/0198097 | A1 | 8/2011 | Moen | |
| 2011/0277989 | A1 | 11/2011 | Frazier | |
| 2011/0297393 | A1 | 12/2011 | Patel | |
| 2011/0303420 | A1 | 12/2011 | Thorkildsen et al. | |

OTHER PUBLICATIONS

Tendeka BV, FloCheck(TM) Valve Inner-string free deployment, 2010.

* cited by examiner

FIG. 4
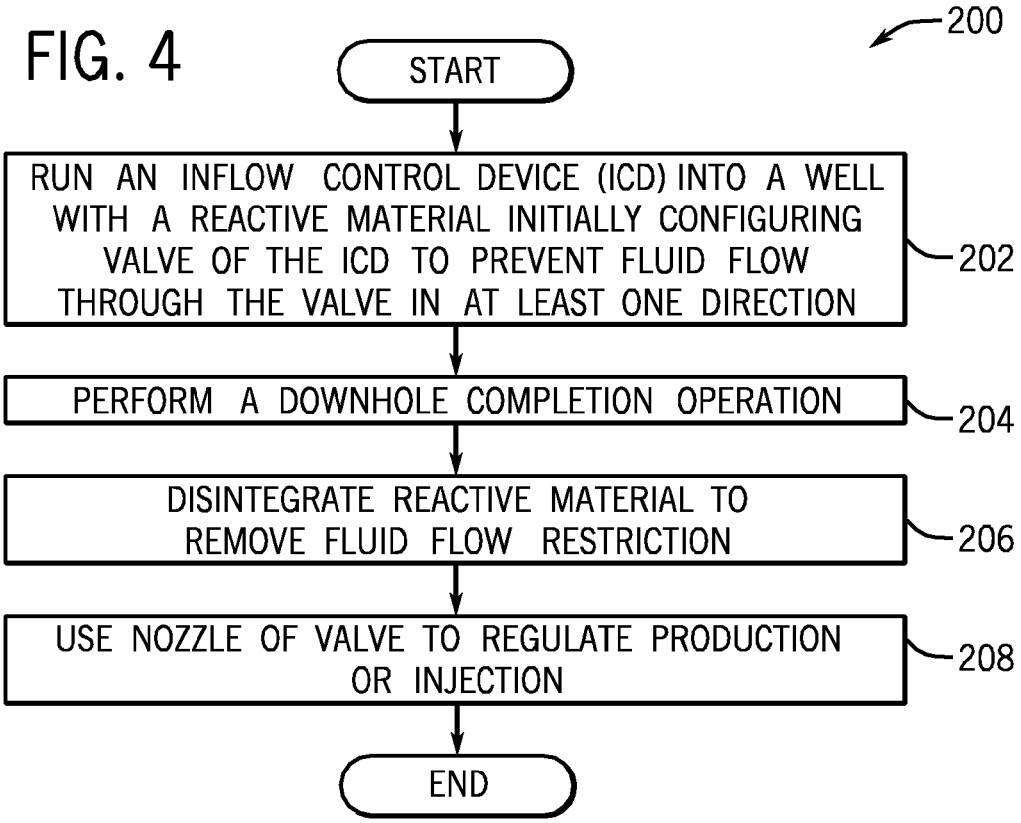
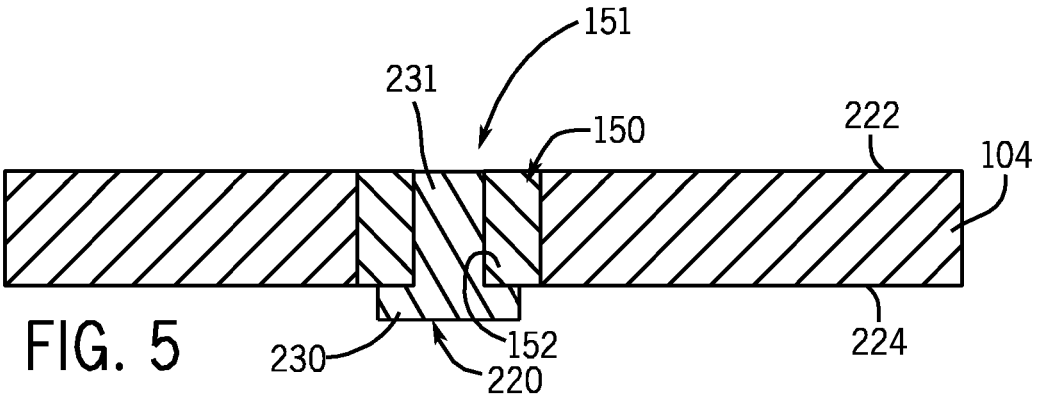
FIG. 5
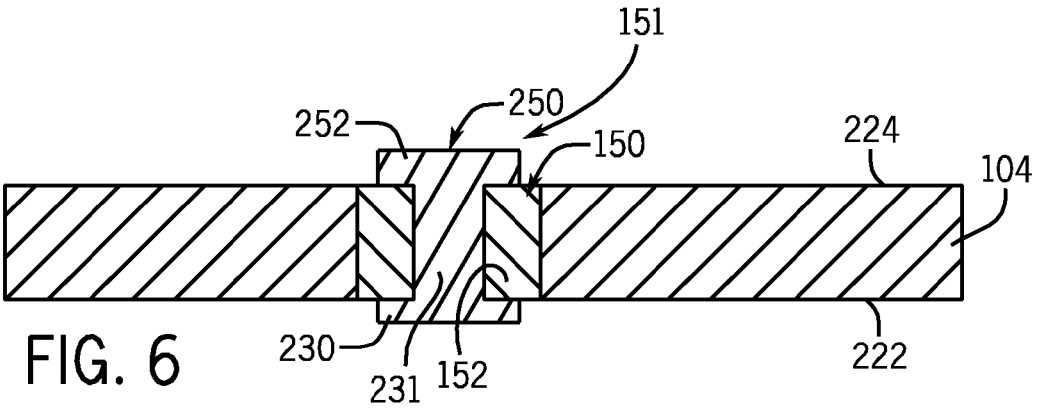
FIG. 6

METHOD AND APPARATUS FOR USE WITH AN INFLOW CONTROL DEVICE

This application claims the benefit under 35 U.S.C. §119 (e) to U.S. Provisional Application Ser. No. 61/354,597, entitled, "WASHPIPE FREE RUNNING OF INFLOW CONTROL DEVICES USING REACTIVE MATERIAL," which was filed on Jun. 14, 2010, and is hereby incorporated by reference in its entirety.

BACKGROUND

The invention generally relates to a method and apparatus for use with an inflow control device.

When well fluid is produced from a subterranean formation, the fluid typically contains particulates, or "sand." The production of sand from the well typically is controlled for purposes like preventing erosion and protecting upstream equipment. One way to control sand production is to install screens in the well and form a filtering substrate around the screens to filter sand from the produced well fluid. A typical sand screen is formed from a cylindrical mesh that is placed inside the borehole of the well where well fluid is produced. Another typical sand screen is formed by wrapping wire in a helical pattern with controlled distance between each adjacent winding. Using a gravel packing operation, gravel is deposited in the annular region that surrounds the sand screen to form a filtering substrate.

In a conventional gravel packing operation, the gravel is communicated downhole via a slurry, which is a mixture of a carrier fluid and the gravel. A gravel packing system in the well directs the slurry around the sand screen so that when the fluid in the slurry disperses, gravel remains around the sand screen.

SUMMARY

In an embodiment of the invention, a technique includes running a completion assembly downhole into a well. The assembly includes a valve and a material that is adapted to initially configure the valve to prevent fluid flow through the valve in at least one direction. The technique includes performing a downhole completion operation in the well and disintegrating the material to allow the prevented fluid flow through the valve. The valve includes a nozzle that is used to regulate production or injection in the well.

In another embodiment of the invention, a completion apparatus includes a base pipe, a screen to circumscribe the base pipe, a valve disposed in the base pipe and a material. A nozzle of the valve regulates the injection or production of fluid between a central passageway of the base pipe and an annular region that surrounds the screen. The material is disposed in the valve when the completion apparatus is run into the well to prevent a fluid flow through the valve in at least one direction and thereafter be disintegrated to allow the prevented fluid flow.

In yet another embodiment of the invention, a system that is usable with a well includes a tubular string that includes completion assemblies to be installed downhole in a wellbore of the well to regulate production or injection. At least one of the completion assemblies includes a base pipe, a screen and valves that are disposed in the base pipe. The base pipe forms part of the tubular string, and the screen circumscribes the base pipe. Nozzles of the valves regulate the production or injection fluid between a central passageway of the tubular string and an annular region that surrounds the screen. The completion assembly includes materials, where each material is adapted to configure one of the valves to initially prevent fluid communication through the valve in at least one direction to allow a completion operation to be performed in the well and thereafter being disintegrated to allow the prevented fluid communication through the valve.

Advantages and other features of the invention will become apparent from the following drawing, description and claims.

BRIEF DESCRIPTION OF THE DRAWING

FIG. 4 is a flow diagram depicting a technique to initially configure an inflow control device nozzle using a reactive material according to an embodiment of the invention.

FIGS. 5 and 6 are cross-sectional views of inflow control device nozzles having reactive material plugs according to embodiments of the invention.

DETAILED DESCRIPTION

Figure 1:
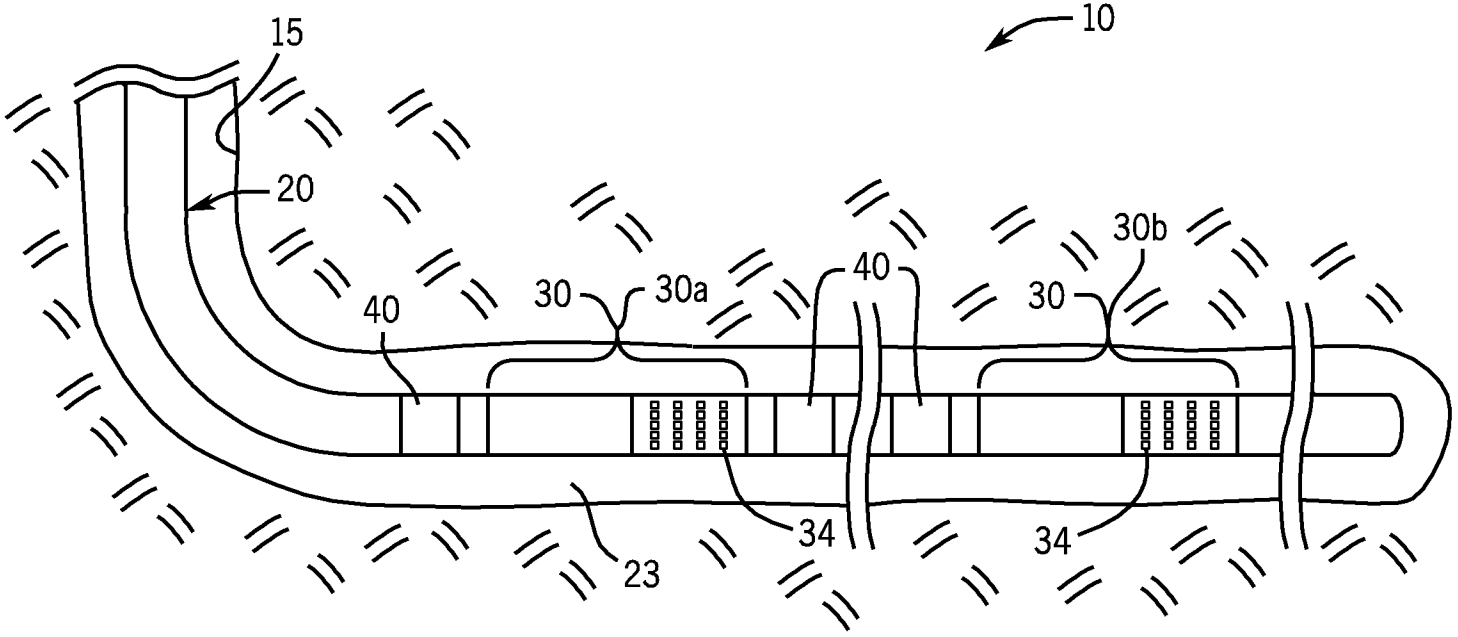
FIG. 1 is a schematic diagram of a well according to an embodiment of the invention.

Referring to FIG. 1, in accordance with embodiments of the invention, a well system 10 may include a deviated or lateral wellbore 15 that extends through one or more formations. Although the wellbore 15 is depicted in FIG. 1 as being uncased, the wellbore 15 may be cased, in accordance with other embodiments of the invention. Moreover, the wellbore 15 may be part of a subterranean or subsea well, depending on the particular embodiment of the invention.

As depicted in FIG. 1, a tubular completion string 20 extends into the wellbore 15 to form one or more isolated zones for purposes of producing well fluid or injecting fluids, depending on the particular embodiment of the invention. In general, the tubular completion string 20 includes completion screen assemblies 30 (exemplary completion screen assemblies 30*a* and 30*b* being depicted in FIG. 1), which either regulate the injection of fluid from the central passageway of the string 20 into the annulus or regulate the production of produced well fluid from the annulus into the central passageway of the string 20. In addition to the completion screen assemblies 30, the tubular string 20 may include packers 40 (shown in FIG. 1 their unset, or radially contracted states), which are radially expanded, or set, for purposes of sealing off the annulus to define the isolated zones.

For the following discussion, it is assumed that the string 20 receives produced well fluid, although the concepts, systems and techniques that are disclosed herein may likewise be used for purposes of injection, in accordance with other embodiments of the invention.

Each completion screen assembly 30 includes a sand screen 34, which is constructed to support a surrounding filtering gravel substrate (not depicted in FIG. 1) and allow produced well fluid to flow into the central passageway of the string 20 for purposes of allowing the produced fluid to be communicated to the surface of the well. Before being used for purposes of production, however, the tubular completion string 20 and its completion screen assemblies 30 are used in connection with at least one downhole completion operation, such as a gravel packing operation to deposit the gravel substrate in annular regions that surround the sand screens 34.

Figure 2:
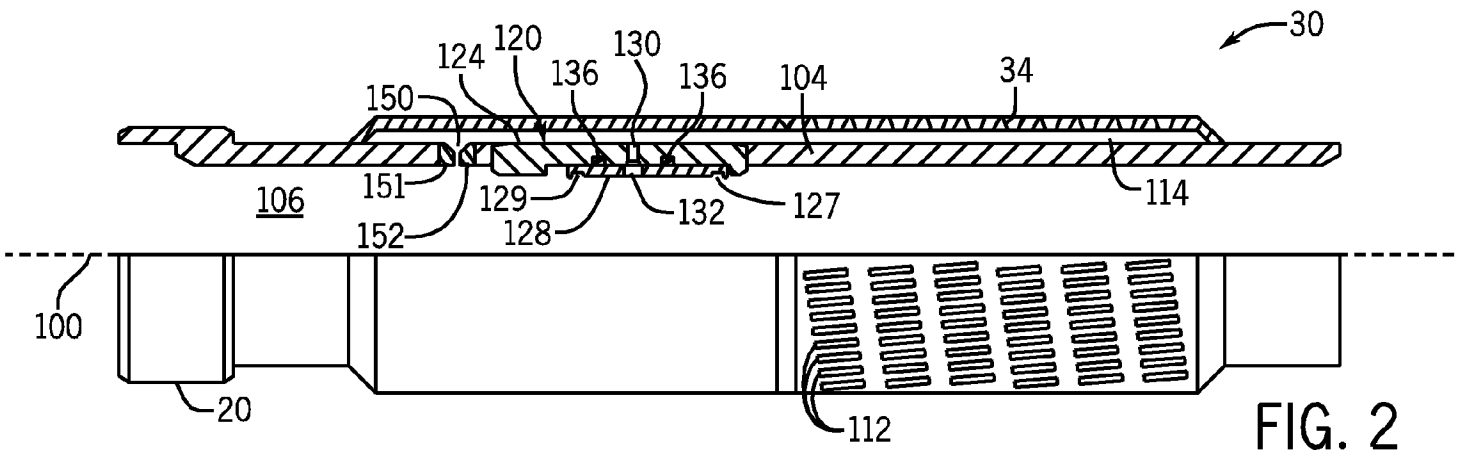
FIG. 2 is a schematic diagram of a completion screen assembly having a sleeve valve that is open according to an embodiment of the invention.

Referring to FIG. 2 in conjunction with FIG. 1, in accordance with some embodiments of the invention, each completion screen assembly 30 includes a base pipe 104 that is concentric about a longitudinal axis 100 and forms a portion of the tubular string 20; and the assembly's sand screen 34 circumscribes the base pipe 104 to form an annular fluid receiving region 114 between the outer surface of the base pipe 104 and the interior surface of the sand screen 34. The completion screen assembly 30 also includes a sleeve valve 120 that forms part of the base pipe 104 (and tubular string 20) for purposes of controlling fluid communication between the central passageway of the base pipe 104 (and tubular string 20) and the fluid receiving region 114.

The sleeve valve 120 includes a housing 124 that forms part of the base pipe 104 and has at least one radial port 130 to establish fluid communication between the fluid receiving region 114 and the central passageway of the base pipe 104. The sleeve valve 120 also includes an interior sliding sleeve 128 that is concentric with and, in general, is disposed inside the housing 124. As its name implies, the sliding sleeve 128 may be translated along the longitudinal axis of the base pipe 104 for purposes of opening and closing radial fluid communication through the port(s) 130. In this manner, the sliding sleeve 128 contains at least one radial port 132 to allow radial fluid communication through the port(s) 132 (and port(s) 130) when the sleeve 128 is translated to its open position. When the sliding sleeve 128 is translated to its closed position (see FIG. 3), seals 136 (o-rings, for example), which are disposed between the outer surface of the sleeve 128 and the inner surface of the housing 124 isolate the ports 130 and 132 from each other, thereby blocking off fluid communication through the sleeve valve 120.

It is noted that FIG. 2 is merely an example of a completion screen assembly in accordance with one of many possible embodiments of the invention. For example, the sleeve valve 120 may be located uphole or downhole with respect to the sand screen 34; and as further disclosed below in connection with FIG. 11, a completion screen assembly 400 may not include a sleeve valve. Thus, many variations are contemplated and are within the scope of the appended claims.

For the exemplary completion screen assembly that is depicted in FIG. 2, the sleeve 128 may be translated between its open and closed positions using a variety of different mechanisms, depending on the particular embodiment of the invention. As a non-limiting example, the sleeve 128 may be translated to its different positions by a shifting tool that has an outer surface profile that is constructed to engage an inner surface profile (such as exemplary inner profiles 127 and 129, for example) of the sleeve 128. Other variations are contemplated and are within the scope of the appended claims.

The sleeve valve 120 is opened (FIG. 2) for purposes of depositing a gravel substrate about the sand screen 34 during a gravel packing operation. In this manner, during the gravel packing operation, the gravel substrate is communicated downhole as part of a slurry that contains the gravel substrate and a carrier fluid. After being deposited around the sand screen 34, the carrier fluid exits the gravel substrate and enters openings 112 of the screen 34. The carrier fluid enters the central passageway 106 of the base pipe 104 through the opened sleeve valve 120 and returns to the surface via the tubular string 20. It is noted that the string 20 may possibly include one or more crossovers for purposes of transitioning the returning flow between the central passageway 106 and the annulus of the well. Thus, many variations are contemplated and are within the scope of the appended claims.

Figure 3:
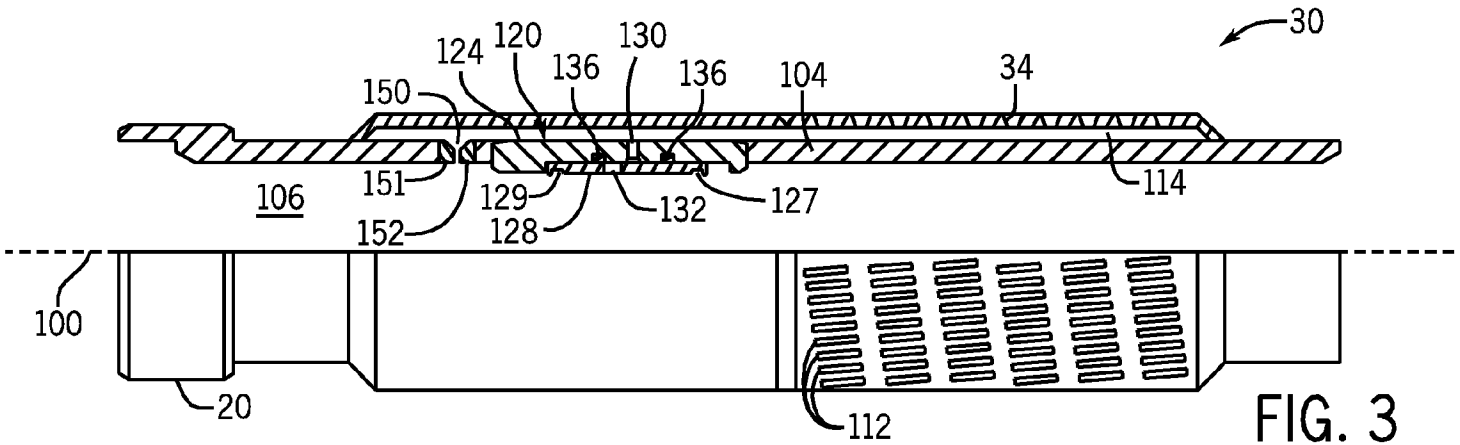
FIG. 3 is a schematic diagram of the completion screen assembly when the sleeve valve is closed according to an embodiment of the invention.

After the region about the sand screen 34 is gravel packed, the sleeve valve 120 is closed as depicted in FIG. 3; and another sleeve valve 120 of another completion screen assembly 30 is opened (with the other sleeve valves 120 being closed) for purposes of gravel packing the region that surrounds the other completion screen assembly 30.

After that the conclusion of any completion operations, such as the above-described exemplary the gravel packing operation, the completion screen assemblies 30 are used for purposes of regulating production or injection. In this manner, each completion assembly 30 includes one or more inflow control device (ICD) valves 150 (one exemplary ICD valve 150 being depicted in FIGS. 2 and 3), which are disposed in the base pipe 104 and contain nozzles 151 (one nozzle 151 being depicted in FIGS. 2 and 3) for purposes of regulating fluid communication between the central passageway 106 of the base pipe 104 and the annulus of the well.

One way to gravel pack a tubular string that contains ICD valves is to use a wash pipe. In this manner, the wash pipe may be run inside the central passageway of the string to isolate the ICD valves so that fluid may be communicated using the string while preventing fluid communication through the ICD valves. However, typically, the wash pipe forms imperfect seals (thereby allowing leakage to occur through the ICD valves); and moreover, using a wash pipe may involve at least one additional run into the well, which may contribute significantly to the expense and time associated with the gravel packing operation.

Referring to FIG. 4 in conjunction with FIGS. 2 and 3, in accordance with embodiments of the invention described herein, a technique 200 may be used to perform a completion operation without using a wash pipe to isolate ICD valves. The technique 200 includes running an ICD into a well with reactive materials, which initially configures the valves of the ICDs in a manner that prevents fluid flow through the valves in at least one direction, pursuant to block 202. For example, in accordance with some embodiments of the invention, the reactive materials initially configure each of the ICD valves to prevent fluid flow in a direction from the central passageway 106 of the base pipe 104 to the annular region outside of the valves. With this configuration, a downhole completion operation (gravel packing operation, for example) may then be performed, which takes advantage of this fluid flow restriction/isolation, pursuant to block 204. When the completion operation is complete, the reactive materials may be disintegrated (block 206) to remove the fluid flow restrictions placed on the ICD valves so that the nozzles of the valves may be used (block 208) to thereafter regulate production or injection.

Referring to FIG. 5 in conjunction with FIGS. 2 and 3, as a more specific example, in accordance with embodiments of the invention disclosed herein, a reactive material plug 220 may initially be inserted into an opening 152 of an ICD nozzle 151 to block fluid flow in a direction from the central passageway 106 of the base pipe 104 to the annular region that surrounds the base pipe 104. In general, the plug 220 has a portion 231 that extends into the opening 152 of the ICD nozzle 151 and contains a flange 230 that contacts the inner surface of the base pipe 104 for purposes of retaining the plug 220 inside the ICD nozzle 151. Thus, with this configuration, leakage is prevented through the valve 150, for example, as the carrier fluid is communicated through the central passageway 106 of the base pipe 104 during a gravel packing operation.

Referring to FIG. 6 in conjunction with FIGS. 2 and 3, alternatively, in accordance with other embodiments of the invention, a reactive material plug 250 may be initially disposed in the opening 152 of an ICD nozzle 151 to block flow in both directions through the valve 150. In this manner, similar to the plug 220 (FIG. 5), the plug 250 contains a portion 231, which extends into the opening 152 and contains a flange that contacts the inner surface 222 of the base pipe 104 for purposes of securing the plug 250 in place to prevent a fluid flow between the central passageway 106 and the region outside of the base pipe 104. Unlike the plug 220, however, the plug 250 also includes a flange 252 that contacts an outer surface 224 of the base pipe 104 for purposes of preventing a flow from the exterior of the base pipe 104 to the central passageway 106 through the valve 150.

Figure 7:
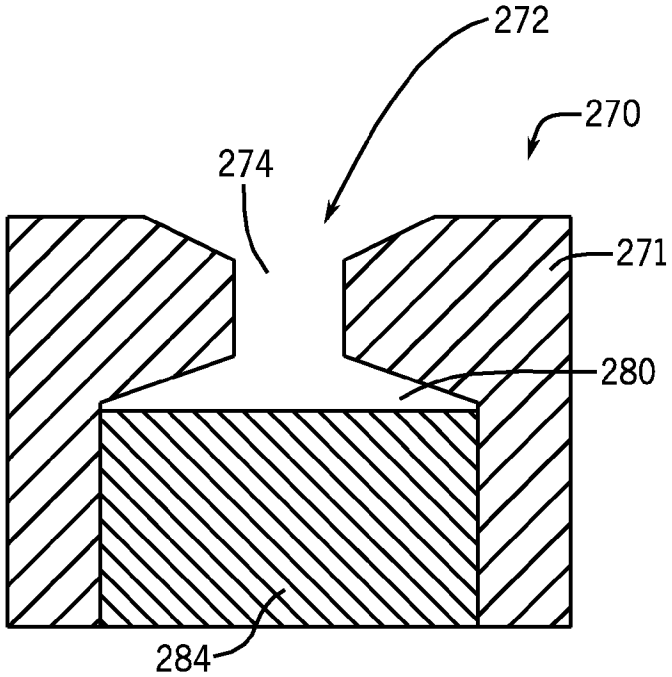
FIG. 7 is a cross-sectional view of an inflow control device valve with a nozzle having a reactive material to initially prevent fluid flow through the nozzle according to an embodiment of the invention.

As another example, FIG. 7 depicts an ICD valve 270 with a nozzle 272, in accordance with another embodiment of the invention. Referring to FIG. 7 in conjunction with FIGS. 2 and 3, for this example, the nozzle 272 has a constricted opening 274 that is formed in a body 271 of the ICD valve 270 for purposes of regulating production or injection through the valve 270. The body 271 also contains an internal chamber 280, which is exposed to the opening 274. As shown in FIG. 7, a reactive material 284 is initially disposed inside the chamber 280 to prevent fluid communication in a direction from the central passageway 106 of the base pipe 104 to the region outside of the base pipe 104 through the nozzle opening 274.

Figure 8:
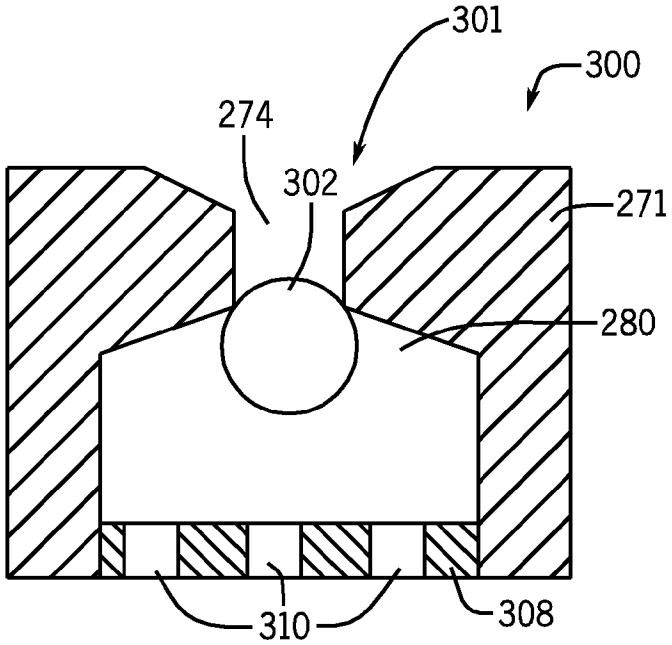
FIGS. 8 and 10 are cross-sectional views of inflow control device valves with nozzles having balls that provide check valve functionality and reactive materials to allow future disabling of the check valve functionality according to embodiments of the invention.

Referring to FIG. 8, in accordance with other embodiments of the invention, an ICD valve 300 with nozzle 301 may be similar in certain aspects to the ICD valve 270 of FIG. 7, in that the ICD nozzle 301 contains a constricted opening 274 that is formed in the ICD valve's body 271 as well as a chamber 280. However, unlike the ICD valve 270, the ICD valve 300 is initially configured to be a check valve. In this manner, the ICD valve 300 is initially enabled by a reactive material to restrict flow in a direction from the central passageway of the base pipe 104 to the region outside of the base pipe 104 (see FIGS. 2 and 3). More specifically, in accordance with some embodiments of the invention, the check valve includes a ball element 302, which has an outer diameter that is sized bigger than the cross-sectional diameter of the opening 274.

In general, as shown in FIG. 8, a reactive material flow plate 308 (containing flow passageways 310) retains the ball element 302 inside the chamber 280 and permits the ball element 302 to travel inside the chamber 280 to allow and restrict flow, depending on the flow direction. In this manner, the check valve prevents fluid communication from the central passageway 106 of the base pipe 104 (see FIGS. 2 and 3) to the annular region that surrounds the base pipe 104 and allows fluid communication in the opposite direction. Because the flow plate 308 is constructed from a reactive material, the flow plate 308 may be disintegrated to allow the ball element 302 to leave the chamber 280, thereby disabling the check valve and permitting fluid communication in both directions.

Figure 9:
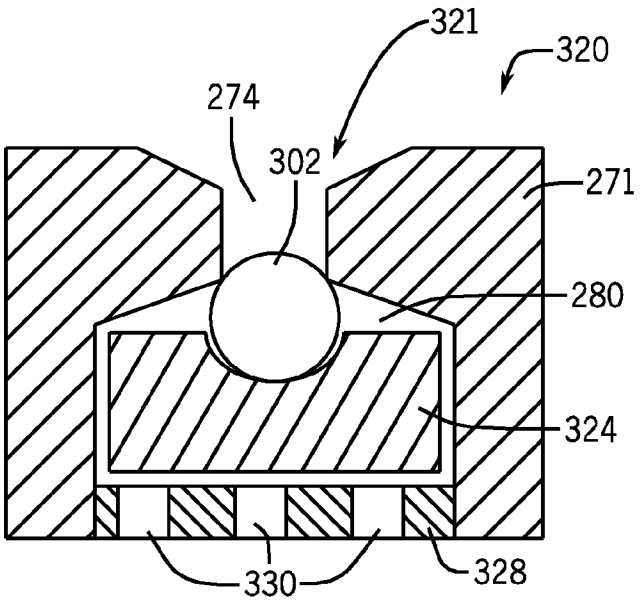
FIG. 9 is a cross-sectional view of an inflow control device valve with nozzle having a ball that provides check valve functionality that is initially dormant due to a reactive material according to an embodiment of the invention.

The ICD valve may alternatively have a check valve functionality that is initially disabled, instead of enabled, using a reactive material, in accordance with other embodiments of the invention. In other words, the reactive material may be used to form a dormant check valve, which is subsequently enabled. Referring to FIG. 9, as a more specific example, an ICD valve 320, in accordance with some embodiments of the invention, includes a body 271 that has a nozzle 321 with a constricted opening 274 and a chamber 280, similar to the ICD valves 270 (FIG. 8) and 300 (FIG. 9). The ICD valve 320 also contains a ball element 302 that has an outer diameter that is sized to not pass through the constricted opening 274.

As depicted in FIG. 9, the ICD valve 320 is configured to initially contain a reactive material 324 that is disposed inside the chamber 280 to restrict travel of the ball element 302 inside the chamber 280 to thereby force the ball element 302 to close the opening 274. Thus, the reactive material 324 initially configures the ICD valve 320 to be closed, regardless of the differential pressure across the ball element 302, in accordance with some embodiments of the invention. The ICD valve 320 also includes a flow plate 328, that, unlike the flow plate 308 of FIG. 8, is not formed of a reactive material, in accordance with some implementations. Upon disintegration of the reactive material 324, the ball element 302 freely moves inside the chamber 280 to cause the ICD valve 320 to become a check valve, which allows flow in a direction from the region outside of the base pipe 104 to the central passageway 106 but prevents flow through the valve 320 in the opposite direction.

Figure 10:
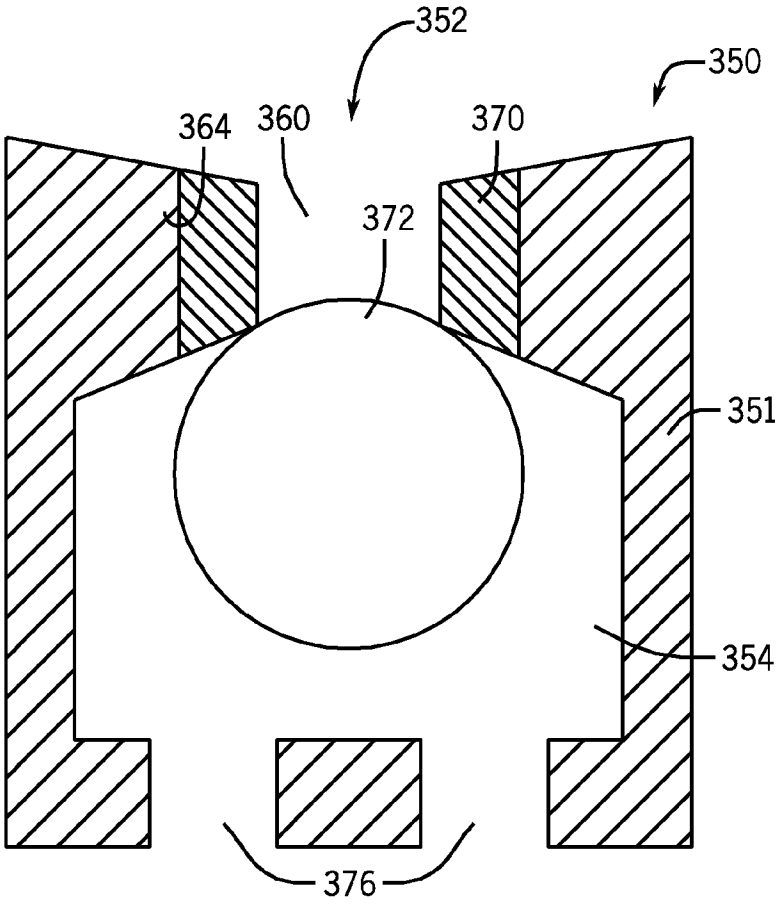

FIG. 10 is an example of another ICD valve 350 that is initially configured to be a check valve but is subsequently disabled through the use of a reactive material. The ICD valve 350 has a body 351 that forms a chamber 354 that contains a ball element 372. In general, the body 351 contains openings 376 to permit communication between the central passageway 106 and the chamber 354. The body 351 also includes an opening 364 that is part of a nozzle 352 of the ICD valve 350 and is sized to allow passage of the ball element 372. However, initially, the opening 364 is further restricted by an annular reactive material ring 370, which has a corresponding opening 360 that is smaller than the diameter of the ball 372. Therefore, due to this arrangement, initially, the ball element 372 is retained inside the chamber 354 to configure the ICD valve 250 to form a check valve that allows flow from the annulus to the central passageway 106 but prevents flow in the opposite direction. However, the reactive material ring 370 may be disintegrated to permit the ball 372 to leave the chamber 354, thereby disabling the check valve functionality of the ICD valve 250 and permitting flow in both directions.

As non-limiting examples, the reactive material may be aluminum or an aluminum alloy, although other reactive materials may be used, in accordance with other embodiments of the invention.

The reactive material may be disintegrated in numerous different ways, depending on the particular embodiment of the invention. For example, in accordance with some embodiments of the invention, a fluid (hydrochloric acid, for example) which reacts with the reactive material may be communicated downhole via the central passageway of the tubing string 20 (see FIG. 1) for purposes of disintegrating the reactive materials (aluminum or aluminum alloys, as non-limiting examples) used to initially configure the ICD valves. As another example, in accordance with some embodiments of the invention, the reactive material may gradually disintegrate due to the exposure of the material to downhole well fluids. Therefore, upon installing the completion assemblies (see FIG. 1 for example), a certain amount of time may be allocated for performing completion operations, which rely on certain configurations of the ICD valves, which are achieved through the use of reactive materials. After this time elapse, the materials sufficiently disintegrate to effectively remove the initial configurations.

Figure 11:
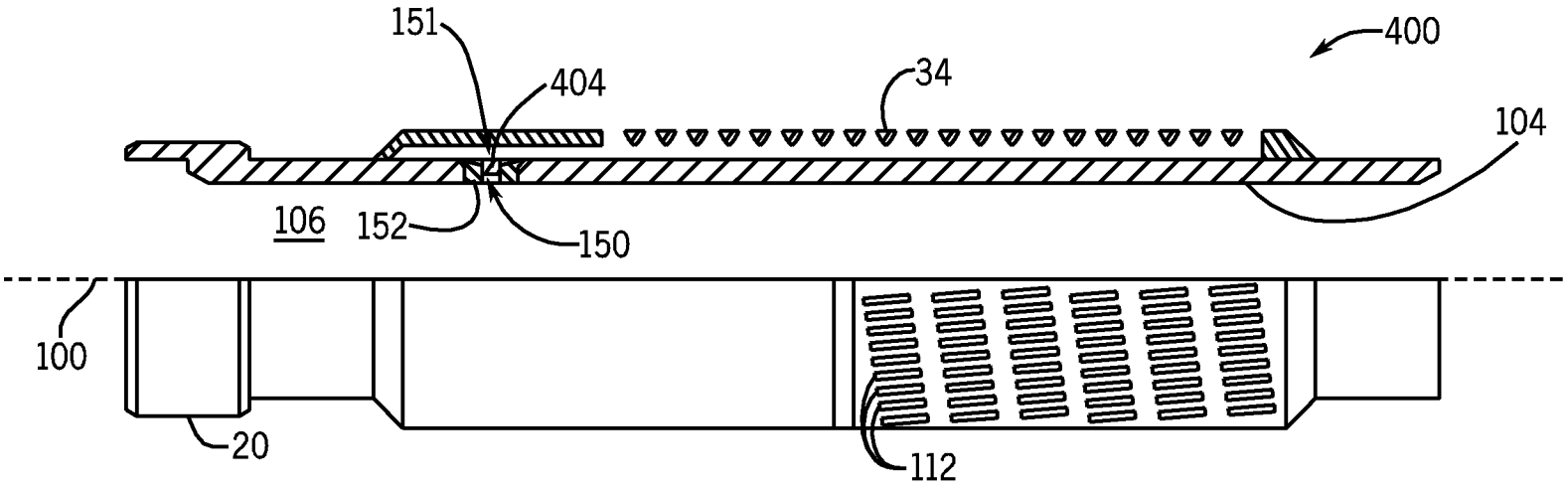
FIG. 11 is a schematic diagram of a completion screen assembly according to another embodiment of the invention.

Other embodiments are contemplated and are within the scope of the appended claims. For example, referring to FIG. 11, in accordance with other embodiments of the invention, unlike the completion screen assemblies disclosed above, a completion screen assembly 400 does not contain a sleeve valve. Similar reference numerals are used in FIG. 11 to show components that are similar to the components of the completion screen assemblies discussed above. For purposes of illustration, FIG. 11 depicts the ICD valve 150 as containing a reactive material plug 404 inserted into the opening 152 of an ICD nozzle 151 to initially block flow through the ICD valve 150, although the ICD valve 150 may be configured using reactive materials in other ways, as discussed above. Thus, many variations are contemplated and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

running a completion assembly downhole into a well, the assembly comprising a check valve and a material adapted to initially configure the check valve to prevent fluid flow through the check valve in at least one direction;

performing a downhole completion operation in the well using the initial configuration of the check valve;

disintegrating the material to allow said fluid flow through the check valve in said at least one direction; and using a nozzle of the check valve to regulate production or injection in the well, wherein the check valve comprises a chamber and a flow element that is adapted to move inside the chamber in response to fluid pressure when operation of the check valve is enabled, and disintegrating the material comprises:

disintegrating the material to increase a range over which the flow element moves inside the chamber to enable operation of the check valve; or disintegrating the material to allow the flow element to leave the chamber to disable operation of the check valve.

2. The method of claim 1, wherein the completion assembly comprises a screen and a base pipe, and the check valve is disposed in a flow path between the inside of the base pipe and the screen.

3. The method of claim 1, wherein the completion assembly comprises a screen and a base pipe, and the check valve is disposed in the base pipe, the method further comprising:

selectively operating a sleeve valve in the base pipe to perform the downhole completion operation.

4. The method of claim 1, wherein the completion assembly comprises multiple base pipe joints with a screen and multiple nozzles.

5. The method of claim 1, wherein the completion assembly comprises a screen;

the completion operation comprises a gravel packing operation;

the act of running comprises running a tubular string comprising the completion assembly into the well; and the act of performing comprising using a central passageway of the string to communicate fluid associated with the gravel packing operation to deposit a gravel packing substrate around the screen.

6. The method of claim 1, wherein the act of disintegrating the material comprises communicating a fluid downhole to react with the material to cause disintegration of the material.

7. The method of claim 1, wherein the act of disintegrating the material comprises exposing the material to a downhole well fluid to cause disintegration of the material.

8. The method of claim 1, wherein the reactive material comprises aluminum or an aluminum alloy.

9. The method of claim 1, wherein disintegrating the material comprises disintegrating a material comprising a flow opening and constructed to retain the flow element in the chamber to disable operation of the check valve.

10. The method of claim 9, wherein the material is disposed in a nozzle of the check valve.

11. The method of claim 9, wherein the material forms a flow plate disposed in an outlet of the check valve.

12. The method of claim 1, wherein disintegrating the material comprises disintegrating a material disposed in the chamber to enable operation of the check valve.

13. A completion apparatus, comprising:

a base pipe;

a screen to circumscribe the base pipe; and a check valve to regulate production or injection in the well via fluid communicated between a central passageway of the base pipe and an annular region surrounding the screen, the check valve comprising:

a chamber;

a flow element disposed in the chamber to move inside the chamber in response to fluid pressure when operation of the check valve is enabled; and a material to disintegrate to increase a range over which the flow element moves inside the chamber to enable operation of the check valve or disintegrate to allow the flow element to leave the chamber to disable operation of the check valve.

14. The apparatus of claim 13, further comprising:

a sleeve valve disposed in the base pipe, the sleeve valve being adapted to be selectively operated to perform a downhole completion operation.

15. The apparatus of claim 13, wherein the material is formed into a plug comprising a cylindrical region to extend into an opening of the nozzle and a flange to engage an outer surface of the base pipe.

16. The apparatus of claim 15, wherein the plug further comprises another flange to engage an inner surface of the base pipe.

17. The apparatus of claim 13, wherein the material comprises aluminum or an aluminum alloy.

18. The apparatus of claim 13, wherein the material is adapted to disable operation of the check valve when the completion apparatus is run into the well.

19. The apparatus of claim 13, wherein the nozzle comprises an opening exposed to a region outside of the base pipe;

the material is disposed in the chamber to position the flow element against the opening to cause the flow element to block fluid communication through the opening when the inflow completion apparatus is run into the well and restrict movement of the flow element; and the disintegration of the material removes the restriction.

20. The apparatus of claim 13, wherein the nozzle comprises an opening exposed to a region outside of the base pipe;

the material is formed into a flow plate that retains the flow element in the chamber when the completion apparatus is run into the well; and the disintegration of the material allows the flow element to flow out of the chamber into an interior passageway of the base pipe to disable the check valve.

21. The apparatus of claim 13, wherein the nozzle comprises an opening exposed to a region outside of the base pipe;

the material is formed into a flow restriction disposed inside the opening when the completion apparatus is run into the well to retain the flow element in the chamber; and the disintegration of the material allows the flow element to flow through the opening and out of the chamber to disable the check valve.

22. The apparatus of claim 13, wherein the material comprises a flow opening and is constructed to retain the flow element in the chamber and is adapted to disintegrate to release the flow element from the chamber to disable the check valve.

23. The apparatus of claim 22, wherein the check valve comprises a nozzle, and the material is disposed in the nozzle.

24. The apparatus of claim 22, wherein the check valve comprises an outlet, and the material forms a flow plate in the outlet.

25. The apparatus of claim 13, wherein the material is adapted to restrict movement of the flow element to disable operation of the check valve, and the material is adapted to disintegrate to release the flow element from the chamber to disable the check valve.

26. A system usable with a well, comprising:

a tubular string comprising a plurality of completion assemblies to be installed downhole in a well bore of the well to regulate production or injection, at least one of the completion assemblies comprising:

a base pipe that forms part of the tubular string;

a screen to circumscribe the base pipe;

a plurality of first valves disposed in the base pipe to regulate said production or injection of fluid between a central passageway of the tubular string and an annular region surrounding the screen; and a plurality of materials, each material being adapted to configure a first valve of said plurality of first valves when said at least one completion apparatus is run into the well to initially prevent fluid communication through the first valve in at least one direction to allow a completion operation to be performed in the well and thereafter disintegrate to allow said fluid communication through a nozzle of the first valve in said at least one direction, wherein at least one of the first valves of the plurality of first valves comprises a check valve, the check valve to regulate fluid communication through a nozzle of said at least one first valve, and at least one of the materials is adapted to disintegrate to:

increase a range over which the flow element moves inside the chamber to enable operation of the check valve; or allow the flow element to leave the chamber to disable operation of the check valve.

27. The system of claim 26, wherein at least one of the materials comprises a plug disposed in one of the nozzles.

* * * * *